US005901981A

United States Patent [19]

Lucht

[11] Patent Number: 5,901,981

[45] Date of Patent: May 11, 1999

[54] ROLLER-SKI AND BRAKE APPARATUS

[76] Inventor: Douglas Allen Lucht, 17017 E. DeAnza Dr., Fountain Hills, Ariz. 85268

[21] Appl. No.: 08/667,096

[22] Filed: Jun. 20, 1996

[51] Int. Cl.[6] ..... A63C 17/06

[52] U.S. Cl. ..... 280/842; 280/11.2; 280/11.22

[58] Field of Search ..... 280/842, 11.2, 280/11.23, 11.22, 11.27, 609

[56] References Cited

U.S. PATENT DOCUMENTS

| | | | |
|---|---|---|---|
| 2,071,220 | 2/1937 | Schniebs | 280/609 |
| 3,365,208 | 1/1968 | Blanchard | 280/11.23 |
| 3,403,919 | 10/1968 | Weibling | 280/842 |
| 3,512,796 | 5/1970 | Mangus | 280/11.22 |
| 3,827,706 | 8/1974 | Milliman | 280/11.1 |
| 4,029,330 | 6/1977 | Runyan, Jr. | 280/87.4 |
| 4,235,448 | 11/1980 | Thomas | 280/11.1 |
| 4,377,297 | 3/1983 | Staufer | 280/609 |
| 4,382,605 | 5/1983 | Hegna | 280/11.22 |
| 4,394,028 | 7/1983 | Wheelwright | 280/11.2 |
| 5,195,781 | 3/1993 | Osawa | 280/842 |
| 5,251,934 | 10/1993 | Gates | 280/842 |
| 5,316,325 | 5/1994 | Mitchell et al. | 280/11.22 |

FOREIGN PATENT DOCUMENTS

| | | | |
|---|---|---|---|
| 314645 | 10/1919 | Germany | 280/11.2 |
| 95297 | 3/1960 | Netherlands | 280/11.22 |
| 651868 | 4/1951 | United Kingdom | 280/11.2 |

*Primary Examiner*—Thomas J. Brahan
*Attorney, Agent, or Firm*—David G. Rosenbaum; Sonnenschein, Nath and Rosenthal

[57] ABSTRACT

A snow ski simulation apparatus which employs a plurality of in-line wheels mounted onto a longitudinally flexible ski chassis member having torsional rigidity which is generally greater than the longitudinal flexibility of the ski chassis. A simulated ski camber is created by providing in-line wheels positioned in spaced apart relationship along the longitudinal length of the ski chassis member. The differential diameter of the spaced-apart in-line wheels facilitates longitudinal flexion of the ski chassis member upon a user weighting or unweighting the ski apparatus in a manner which simulates snow skiing. In this manner the ability of the user to turn and modulate the arc of each turn by angulation relative to the running surface and weighting and unweighting of the ski apparatus is greatly enhanced.

20 Claims, 3 Drawing Sheets

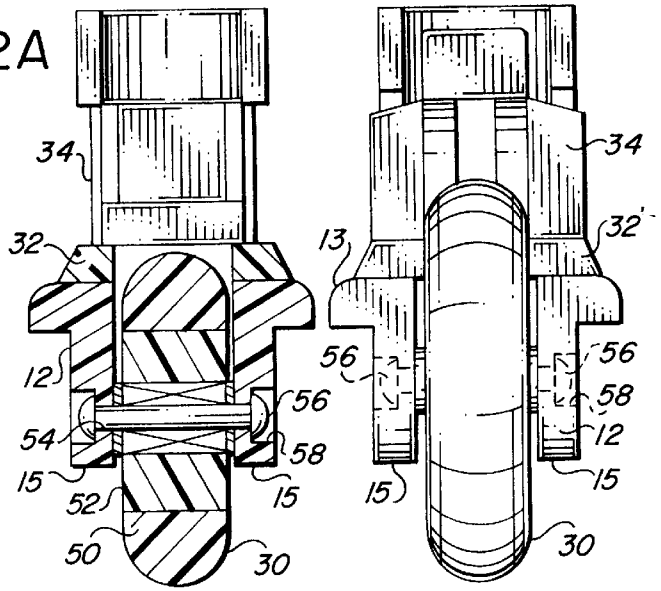
Fig. 2
Fig. 2A
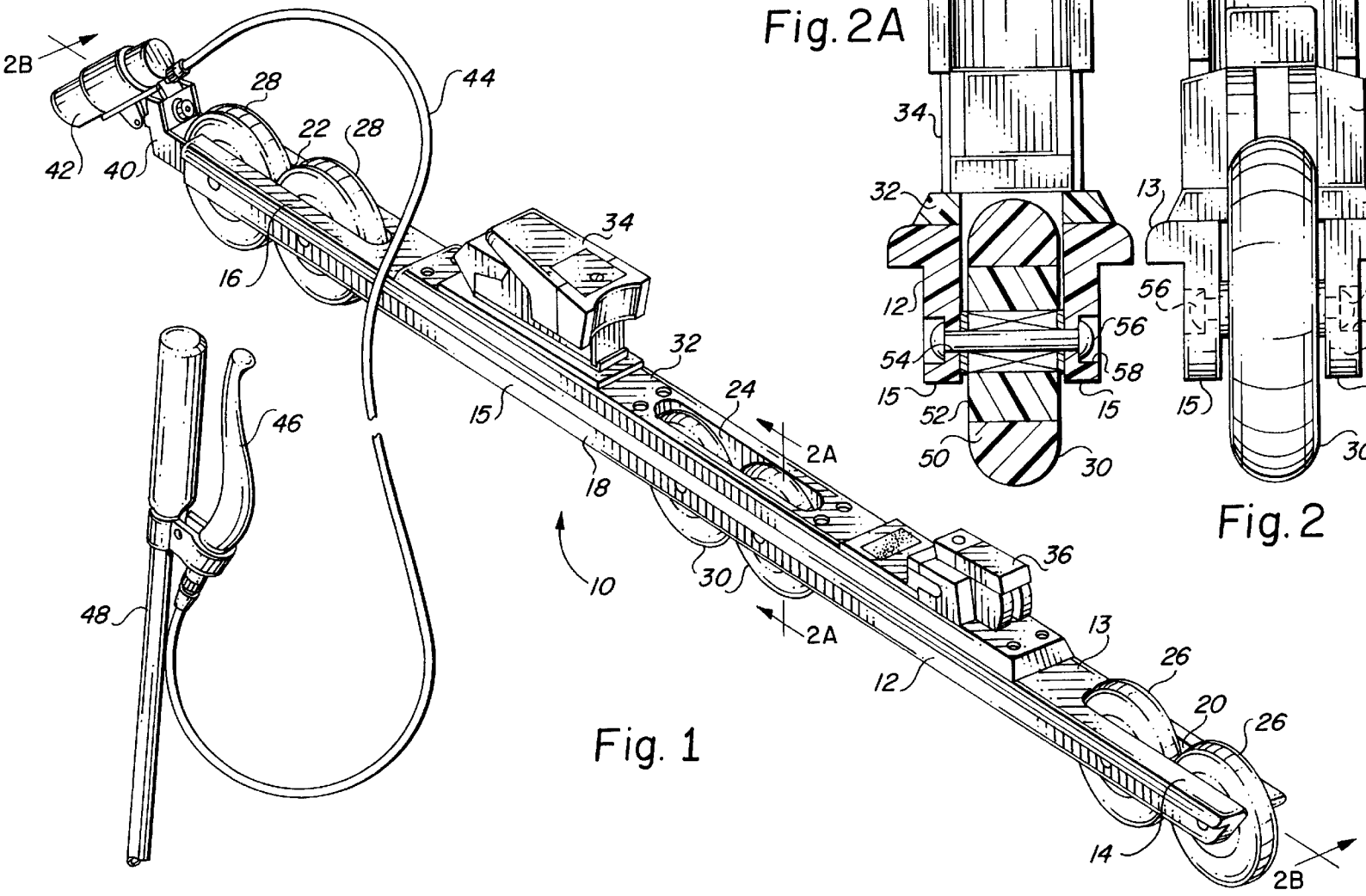
Fig. 1

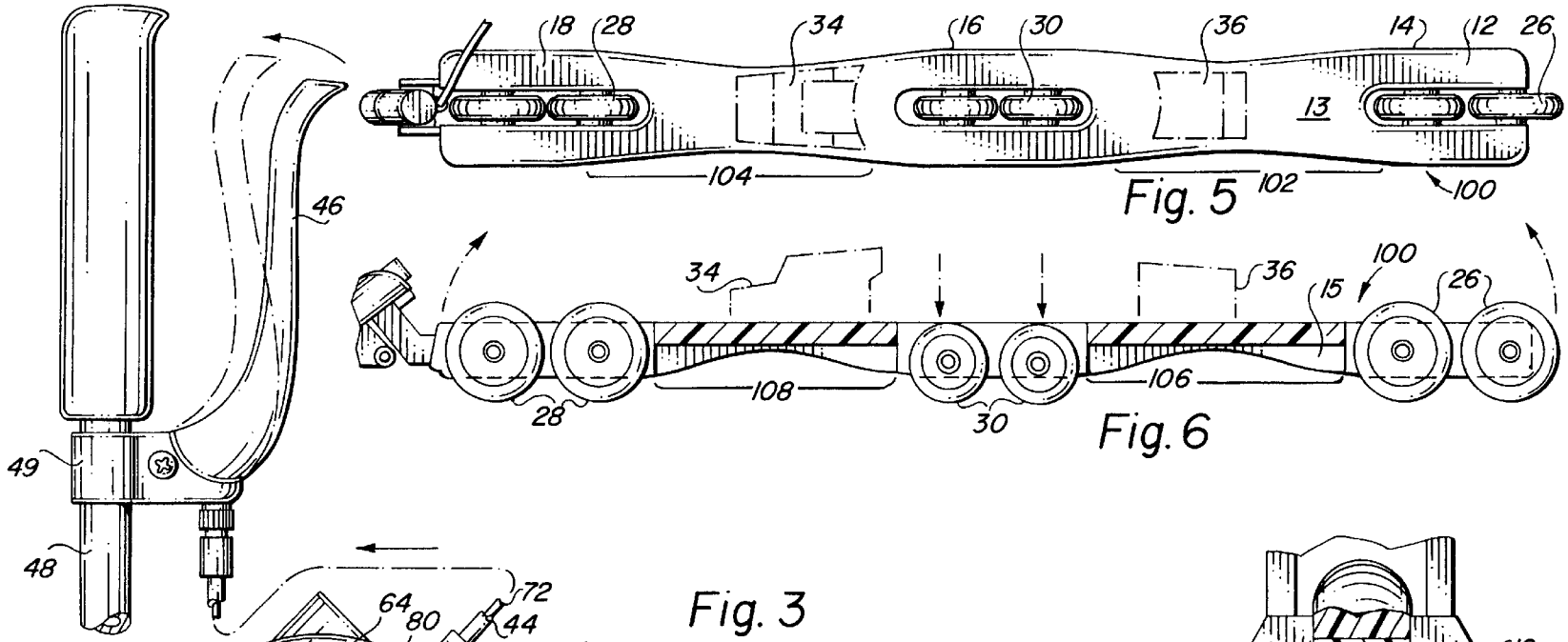
Fig. 5
Fig. 6
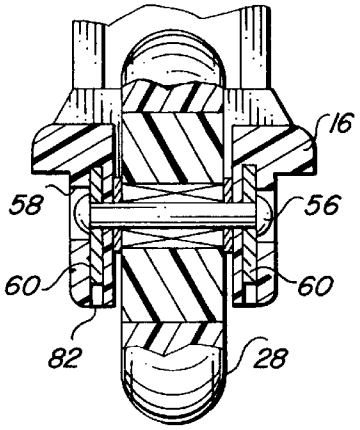
Fig. 4
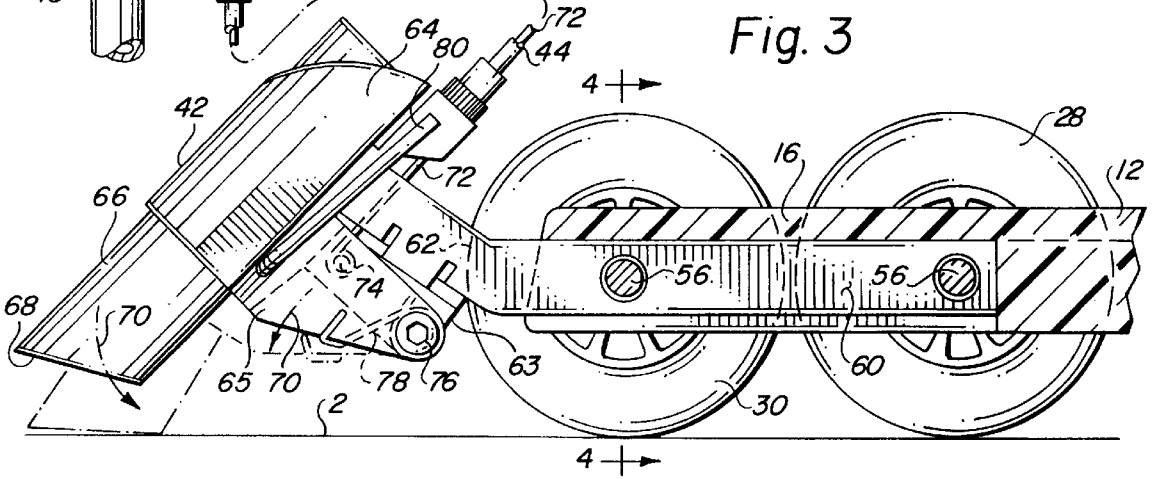
Fig. 3

ROLLER-SKI AND BRAKE APPARATUS

BACKGROUND OF THE INVENTION

The present invention relates generally to devices used in dry-land simulation of snow skiing. More particularly, the present invention relates to a snow ski simulation apparatus which employs a plurality of in-line wheels mounted onto a longitudinally flexible ski chassis member having torsional rigidity which is generally greater than the longitudinal flexibility of the ski chassis. A simulated ski camber is created by providing in-line wheels positioned in spaced apart relationship along the longitudinal length of the ski chassis member. The differential diameter of the spaced-apart in-line wheels facilitates longitudinal flexion of the ski chassis member upon a user weighting or unweighting the ski apparatus in a manner which simulates snow skiing. In this manner the ability of the user to turn and modulate the arc of each turn by angulation relative to the running surface and weighting and unweighting of the ski apparatus is greatly enhanced.

The present invention consists generally of a plastic ski chassis and has six in-line wheels arranged as a forward pair, a rear pair and a centrally positioned pair located immediately underneath the user's feet. The diameter of the wheels in the forward and rearward pair are identical and the wheel diameter of the central pair of wheels is smaller in diameter than the forward or rearward pairs. The differential diameter between the forward and rearward pairs and the central wheel pair allows the ski to flex and simulate a ski camber characteristic of snow skis. The ski chassis is preferably made of a high density plastic milled to a substantially T-shaped axially cross-sectional shape and preferably has a wider mid-section which laterally tapers to narrower toe and heel sections of the ski. The ski chassis may have alternative shapes such as laterally thickened sections immediately underneath toe and heel binding positions and narrower waist sections immediately adjacent the wheel positions. The front and rear wheel pairs reside in forwardly and rearwardly extending vertically-oriented slots and are mounted on axles passing laterally through the ski chassis which form a wheel hub for the two in-line roller blade type wheels in each of the forward and rearward slots. A central vertically extending slot accommodates the central pair of in-line roller blade type wheels and are mounted onto axle hubs which pass laterally through the ski to support the wheel hubs of the in-line roller blade wheels.

All wheel pairs extend through both the under side and the top side of the ski chassis. In particular, the central wheel pair projects radially upward from the top surface of the ski chassis and, its position necessitates either a vertically thickened central section to accommodate the added radial height of the wheels above the plane of the top surface of the ski chassis or a series of spacers which permit the sole of the user's boot to clear the wheel and not impinge upon the wheel to impede rotational movement of the wheel within the central slot.

Another aspect of the invention is the use of either standard release snow ski bindings which provide both an upward and lateral release positions and accommodate and will release the ski chassis from the wearer's feet in the event the user falls and a torsional force is applied which may be injurious to the user.

The "roller ski" of the present invention may be used with ski boots, if snow ski type bindings are utilized or, alternatively, may have appropriate mounting pieces to accommodate either threaded type mounts or buckle type mounts to permit attachment of roller blade-type boots to the ski.

DESCRIPTION OF THE PRIOR ART

U.S. Pat. No. 3,365,208, issued to Blanchard in 1968 discloses a roller ski having a single forward and a single rear wheel with the axle hubs of each wheel being substantially coalligned with the front and rear edges of the ski chassis. Each ski chassis includes a heel and toe binding, illustrated in this patent as being a cable binding type heel holding heel mechanism and the toe piece being a release type toe binding capable of releasing the wearer's foot in the event of an application of sufficient torque such as from the user falling. This patent, while generally relevant to the concept of using a snow ski type binding on a roller ski, does not does not disclose differential wheel diameters sufficient to allow the ski to have an inherent camber for turning.

The Milliman patent, U.S. Pat. No. 3,827,706, issued in 1974 discloses a roller ski concept in which the ski chassis is a generally elongate substantially planer ski member having ski binding mounted on an upper surface of the planer ski member. The binding disclosed is a conventional snow ski type binding of that era, which provides for release of the wearer's foot from the binding in the event of application of a sufficient torsional force to the foot. The ski device of this patent has a plurality of tracking wheels mounted on the underside of the ski member which rotate horizontal transverse axis and are freely rotatable about its rotational axis. As perhaps best illustrated in FIG. 3, the wheels are arrayed in a series of 1) a forward wheel positioned immediately forward of the toe, 2) a rearward wheel which is positioned immediately rearward of the heel, and 3) laterally adjacent pairs of fixed or non-rotatable wheels on immediately one pair being positioned immediately under the wearer's toes and one being positioned immediately under the wearer's heels on both of the inside and outside edges of the ski member. The pair of laterally adjacent wheels (26) in FIG. 3 have a shorter height profile and project a smaller distance downwardly from the lower surface of the ski member than do the front and rear freely rotatable wheels (24). This configuration permits the user to edge by weighting the board edge causing the wheels (26) to impinge upon the rolling surface in conjunction with the forward and rearward wheels (24). In this manner, a frictional force aids in turning the wheels. This patent is the first which appears to discuss the concepts of differential positioning of the wheels in order to optimize turning capability of the ski.

The Runyan, Jr. patent, U.S. Pat. No. 4,029,330, issued Jun. 14, 1997, discloses a cambered skateboard having a track assemble which conforms to the curvature of the board and which allows for longitudinal adjustment of the wheel trucks mounted on the tracks. FIGS. 1–4 of the Runyan patent illustrate a double camber in which the front and rear portions of the board curve upwardly and a central section is depressible under a user's weight. FIGS. 5–8 illustrate a second embodiment in which the rear truck assembly is stationary and the forward section or nose of the board is curved downwardly, and the front truck assembly only is adjustable on its track. A particular objective of this invention is the interaction between the longitudinal adjustment of the wheel trucks which varies the camber characteristics of the board as well as providing for variable wheel base length. It is important to note, however, that because the no middle or intermediate set of wheels, the camber does not serve to weight or unweight intermediate set of wheels to facilitate turning of the skateboard in a manner similar to that of the present invention.

The Thomas patent, U.S. Pat. No. 4,235,448 issued on Nov. 25, 1980, discloses a skateboard-type device for skiing simulation. This patent discloses forward and rear skateboard-type trucks and a foot platform which is recessed from the upper most plane of the wheel trucks. The foot platform is laterally pivotable relative to the wheel axles. This configuration permits the foot platform to reside much closer to the travel surface than in conventional skateboards and permits the foot platform to cant laterally sideways in a pivotable fashion to simulate ski edging. While the device in this patent is intended to simulate skiing, it does so based upon lateral movement of a skateboard platform which does not incorporate the combination of in-line wheels of the present invention, nor does it incorporate any mechanism for assisting turning using the camber of the ski chassis as in the present invention. Rather, the intent behind the device of this patent is to simulate the edging control of snow skiing.

The Hegna patent, U.S. Pat. No. 4,382,605, issued in 1983, discloses a tilt steering assembly for in-line wheeled or runner equipped skate type mechanisms. This patent is related to a roller blade type boot which is fixed to a frame and the frame carries two pairs of suspension members being carried within one side of the frame projecting downwardly from the underside of the wearer's boot. The suspension members are capable of lateral rotation such that the forward pairs and the rearward pairs become offset from a center line to facilitate turning. The offsetting of the forward and rearward pairs is illustrated in FIGS. 2 and 3. The non-parallel geometry of the forward and rearward pairs is achieved by laterally weighting the wheel pairs which forces the wheel pairs to either the inside or outside edge of the boot thus changing the configuration of wheel alignment from an in-line configuration to a curved configuration as illustrated in FIGS. 2 and 3 of that reference.

Finally, the Osawa patent, U.S. Pat. No. 5,195,781, issued in 1993, discloses a grass roller ski board in which the roller ski board has a shape and length similar to a snow ski which has an arched curvature or camber when viewed in side view and a narrowed waist with a larger shovel and tail similar to that of a snow ski. The roller ski board has a plurality of roller pairs positioned along the longitudinal axis of the roller ski and which project laterally from the underside of the roller ski chassis. As illustrated in FIGS. 4*a*, 4*b*, and 4*c*, the roller pairs are provided with varying wheel size and diameters such that the center positioned pairs have the smallest diameter with larger diameter wheels appearing or being used towards the shovel and tail ends of the roller ski. As described in Col. 6, Lines 64–69, the rollers 8*a*, 8*b*, 8*e*, and 8*f* have a differential diameter relative to the rollers 8*c* and 8*d* in the center section of the ski body. While the roller skis disclosed in this Osawa patent are perhaps the most functionally similar to the present invention, the use of in-line roller pairs which increases edge control of the ski in combination with the camber associated solely by the differential diameter of the wheels rather than the curvature of the ski chassis itself offers significant performance advantages over the device in the Osawa patent.

SUMMARY OF THE INVENTION

It will be recognized by those skilled in the relevant art, that there is a long felt, yet unfulfilled need for a non-snow surface snow skiing simulation apparatus which permits the user to faithfully simulate virtually all physical movements and sensory experiences associated with snow skiing, yet do so on ambient, existing non-snow surfaces such as streets, sidewalks, or grassy or dirt surfaces such as are found at mountainous ski areas during non-winter months when there is no snow cover.

It is, therefore, a principal object of the present invention to provide a snow ski simulation apparatus which permits the user to faithfully simulate virtually all physical movements and sensory experiences associated with snow skiing.

It is another object of the present invention to provide a snow ski simulation apparatus which is safe to use, has ample high speed directional stability on many different non-snow surfaces, permits the user to accurately and safely execute turns, provides the user a brake mechanism to allow for deceleration and stopping and which permits the user to utilize his/her ski boots, ski poles and ski bindings.

It is still another object of the present invention to provide a dry-land snow skiing simulator apparatus consisting generally of an elongate longitudinally flexible and substantially torsionally rigid ski chassis member having a forwardly extending forward section, a rearwardly extending rear section and an intermediate section between the forward and rear sections and positioned substantially in-line with a sagittal plane of a human user. The ski chassis member further has a generally planar top surface extending along an entire longitudinal axis of the ski chassis member and having a laterally extending width in its lateral axis, and a bottom projection extending along the entire longitudinal axis of the ski chassis member and having a laterally extending width in its lateral axis which is less than that of the generally planar top surface. The ski chassis member, therefore, has a generally T-shaped transverse cross-sectional shape when viewed along its longitudinal axis.

A binding plate member is attached in substantially co-planar relationship with and to the generally planar top surface of the ski chassis member and toe and heel binding members may be attached by suitable attachment means to forward and rear sections of the binding plate member.

In order to facilitate dry-land, non-snow surface movement, a plurality of in-line wheel pairs, preferably three pairs, are operably attached to the ski chassis member. To accommodate attachment and unimpeded rotational movement of each of the plurality of in-line wheel pairs, a plurality of slots are provided in the ski chassis member. Each of the plurality of slots are dimensioned in both length, width and depth of the slot in order to operably receive one of the plurality of in-line wheel pairs therein. In accordance with the later described preferred embodiments of the present invention, three slots are provided. A forward slot is provided in the forward section of the ski chassis member, a rear slot is provided in the rear section of the ski chassis member and a central slot is provided in the intermediate section of the ski chassis member. Each of the forward, rear and central slots in the ski chassis member open to and extend from the bottom projection of the ski chassis member through to the generally planar upper surface of the ski chassis member and are, therefore, open slots in each of the upper and lower surfaces of the ski chassis member. Each wheel in each of the plurality of in-line wheel pairs are rotatably retained within the slots by wheel axle members inserted through co-axially aligned lateral openings projecting laterally through the bottom projection of the ski chassis member and extending from a first lateral side of the ski chassis member through the ski chassis member to a second lateral side of the ski chassis member.

An important aspect of the present invention is the provision of differential wheel diameters between the forward and rear in-line wheel pairs and the central in-line wheel pair. By providing the forward and rear-in line wheel pair with a larger diameter than the central in-line wheel pair, only the forward and rear in-line wheel pairs contact the dry-land, non-snow running surface when no external weight is applied to the intermediate section of the ski chassis. In this configuration, central in-line wheel pair, being of a smaller wheel diameter, do not contact the running surface when the intermediate section of the ski chassis member is unweighted. However, when the intermediate section of the ski chassis member is weighted, such as by a user wearing the ski chassis member on the users feet, the ski chassis member flexes along its longitudinal axis, the central in-line wheel pair of the intermediate section of the ski chassis member is urged into contact with and bears upon the dry-land, non-snow surface and the front and rear sections of the ski chassis member flex relatively upwardly with respect to the intermediate section of the ski chassis member. Those skilled in the art will appreciate that while the ski simulation apparatus of the present invention is in its longitudinally flexed condition, lateral angulation of the apparatus, such as by an user adjusting his/her weighting in a lateral direction to simulate edging on snow by rotating the users knees relative to the users hips, the plurality of in-line wheel pairs pivot or become angularly displaced from a normal perpendicular orientation relative to the dry-land surface. When in the longitudinally flexed and laterally pivoted position, the plurality of in-line wheel pairs are positionally offset relative to one another. In this condition, the intermediate in-line wheel pair is laterally offset from the front and rear in-line wheel pairs and the plurality of in-line wheel pairs thereby track a curvilinear line on the running surface when put in motion thereupon.

Those skilled in the art will understand and appreciate from the following more detailed description of the preferred embodiments of the present invention, taken with reference to the accompanying figures, that the present invention offers significant advantages and improvements over wheeled ski-simulator devices which were heretofor known in the art.

BRIEF DESCRIPTION OF THE DRAWINGS

FIG. 1 is a perspective view of the inventive roller ski apparatus in accordance with the preferred embodiment of the invention.

FIG. 2 is a front end elevational view of the inventive roller ski apparatus.

FIG. 2A is a cross-sectional view taken along line 2A—2A of FIG. 1.

FIG. 3 is a side-elevational, partial cross-sectional view of a rear section of the inventive roller ski apparatus illustrating a brake mechanism and operation thereof.

FIG. 4 is a cross-sectional view taken along line 4—4 of FIG. 3.

FIG. 5 is a top elevational view of a second preferred embodiment of the present invention illustrating an alternate configuration of the inventive roller ski apparatus.

FIG. 6 is a side elevational, partial cross-sectional view of the second preferred embodiment of the present invention.

DETAILED DESCRIPTION OF THE PREFERRED EMBODIMENTS

Figures 2B, 7, 8, 9:
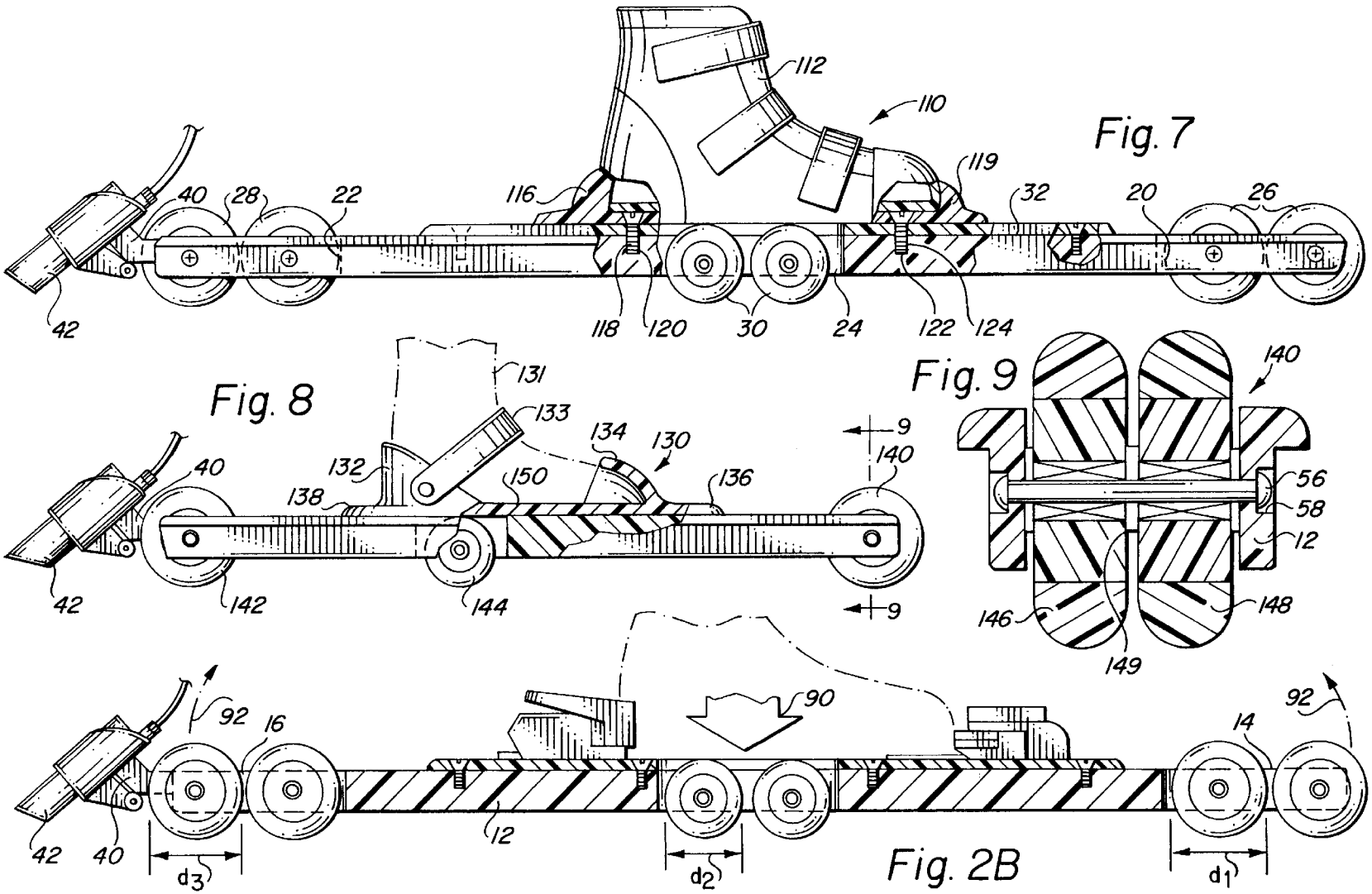
FIG. 2B is a partial cross-sectional view taken along line 2B—2B of FIG. 1 illustrating longitudinal flextion of the inventive roller ski apparatus upon weighting of an intermediate section of the roller ski apparatus.
FIG. 7 is a side elevational view of a third preferred embodiment of the present invention illustrating first alternative means for mounting a user's boot upon the inventive roller ski apparatus.
FIG. 8 is a side elevational, partial cross-sectional view of a fourth preferred embodiment of the present invention, illustrating a second alternative means for mounting a user's boot upon the inventive roller ski apparatus.
FIG. 9 is a cross-sectional view taken along line 9—9 of FIG. 8.

Turning now to the accompanying drawings, in which like elements are identified by like reference numerals, and with particular reference to FIGS. 1–4, the preferred embodiments of the inventive ski simulation apparatus 10 will be more fully understood by those skilled in the art. The ski simulation apparatus 10 consists generally of a chasis member 12 having an elongate configuration defining a front section 14, a rear section 16 and an intermediate section 18 positioned between the front section 14 and the rear section 16. The chassis member 12 may be made of any suitable length to accomodate a user's prefererance. It has been found preferable, however, to provide the chassis member 12 with a length sufficient to accomodate the length of a user's foot, while permitting longitudinal stability of the chassis member 12. Suitable lengths have been found at between 0.5 to 2.0 meters, with a preferred length of the chassis member 12 being about one meter. The chasis member 12 has a generally planar top section 13 which extends along an entire longitudinal length of the chassis member 12 and a downwardly extending projection 15 which also runs along an entire longitudinal length of the underside of chassis member 12. The downwardly extending projection 15 may be formed as an integral part of the top section 13 or as a discrete member coupled to the top section 13. Furthermore, the downwardly extending projection 15 may have either a generally square transverse sectional shape with parallel lateral sidewalls, or as a generally trapezoidal transverse sectional shape which tapers downward and inward toward the median line of the ski chassis member 12. In addition to serving as wheel mounts, the downward projection 15 increases the torsional rigidity of the ski chassis member 12 while permitting longitudinal flexibility of the ski chassis member 12.

A plurality of slots 20, 22, 24, co-axially aligned along the longitudinally axis of the chassis member 12, pass through the chassis member 12 and open at the top surface 13 and below the projection 15. It is preferable that at least one of the plurality of slots be positioned at each of the front section 14, rear section 16 and intermediate section 18 of the chasis member, thereby forming a front slot 20, a rear slot 22 and an intermediate slot 24. Each of the front slot 20, the rear slot 22 and the intermediate slot 24 act as wheel wells which house at least one of a plurality of wheel members 26, 28, 30 therein and permit free rotation of each of the plurality of wheel members 26, 28 and 30 therein. Those skilled in the art will understand that while the projection 15 may be configured as a pair of parrallel relatively narrower downwardly extending ribs, in order to maximize the structural integrity of the apparatus 10, it is preferable that the projection 15 be a single member and that the plurality of slots 20, 22, 24 define laterally adjacent interior walls to house the at least one of a plurality of wheel members 26, 28, 30. The co-axial alignment of the plurality of slots 20, 22 and 24 along the longitudinal axis of the chassis member also positions the plurality of wheel members 26, 28, 30 in co-axial alignment along the longitudinal axis of the chassis member 12 in a manner similar to in-line roller skates marketed under the name ROLLERBLADES. The wheel members 26, 28 and 30 may be any type of wheel having any of a wide variety of wheel diameters and width profiles. Preferably, however, the wheel members 26, 28 and 30 have diameters between 65 and 85 mm, have rounded contact surface profiles 50 to enhance lateral angulation of the wheel, are made of a highly durable, polymer plastic concentrically mounted onto a roller bushing wheel hub 52. The types of wheel members most suitable for use in the present invention are wheels made for ROLLERBLADE-type in-line skates and are well known in the art. To enhance the longitudinal stability of the ski chassis member, it has been found preferable to array the plurality of wheel members 26, 28, 30 as a series of wheel pairs, namely a front wheel pair 26, a rear wheel pair 28 and an intermediate wheel pair 30, all disposed in-line with one another along the longitudinal length of the ski chassis member 12 and co-axially aligned with a median line of the ski chassis member 12.

Each of the plurality of wheel members 26, 28, 30 are rotatably coupled to the ski chassis member 12 by axle members 56 which pass centrally through laterally opposing openings in each of the front slot 20, rear slot 22 and intermediate slot 24 and the projection 15 and through the wheel hub 52, to secure each of the plurality of wheel members 26, 28 and 30 therein.

In accordance with an especially preferred embodiment of the invention, and as illustrated in FIG. 2B, each of the front in-line wheel pair 20 and rear in-line wheel pair 22 wheel member have wheel diameters $d_1$ and $d_3$, respectively, while the intermediate in-line wheel pair 24 has a wheel diameter $d_2$ which is less than that of either $d_1$ and $d_3$. For example, it has been found desirable to provide wheels in which $d_1$ and $d_3$ is 80 mm, while $_2d$ is selected as 72 mm. A differential wheel diameter of between about 8% and 15%, preferably 10–12% between the front in-line wheel pair 20, the rear in-line wheel pair 22 and the intermediate in-line wheel pair 24 has been found to optimally permit longitudinal flexion of the ski chassis member under the influence of a downwardly oriented load 90 and facilitate turning at both low and high speeds of up to 80 mph. Downwardly oriented load 90 causes the intermediate section 16 to flex downwardly so that the intermediate in-line wheel pair 24 is in contact with the running surface. In turn, each of the front section 14 and the rear section 16 are relatively displaced in an upward directional vector 92. The resulting flexed configuration of the ski chassis member 12 simulates the camber of a snow ski and, when the ski chassis member is laterally weighted to simulate edging by pivoting the ski chassis member 12 on the plurality of wheels 26, 28 and 30 and angularly displaced it to one side or the other, such as by the user angulating his body position in a turn, the plurality of wheel members 26, 28, 30 are positioned to define an arc which, while moving, aids in making turns.

As illustrated in FIGS. 2, 2A and 4, the ski chassis member 12 has a generally T-shaped transverse sectional shape, with the planar top section 13 forming the top section of the T-shape and the downwardly extending projection 15 forming the downward section of the T-shape. Each of the slots 20, 22, 24 pass vertically through the ski chassis member 12 and are open through the planar top section 13 and the downwardly extending projection 15. In this manner, each of the slots 20, 22, 24 subdivide the ski chassis member 12 along its median line into spaced- apart inverted L-shaped sections which define lateral sides of each of the plurality of slots 20, 22, 24. When at least one of a plurality of wheel members, e.g., 30, is positioned within one of the plurality of slots 20, 22, 24, each wheel member is operably secured within the slot by passing an axle member 56 transversely through the downwardly extending projection 15 utilizing the opposing openings 58 in the downwardly extending projection on each lateral side of each of the plurality of slots 20, 22, 24. The axle member 54 also passes through a central axle bore 54 in the wheel member 30 such that it is freely rotatable about the central axle bore 54 within the one of a plurality of slots 20, 22, 24.

For ease of manufacturing only, it has been found preferable, through not necessary, to configure the front slot 20 to have an open end at a forward area of the forward section 14 and the rear slot 22 to have an open end at a rear area of the rear section 16. In this configuration, as illustrated in FIG. 1, the front slot 20 and the rear slot 22 have a generally U-shaped configuration which facilitates mounting the plurality of wheel members 26, 28 within their respective front slot 20 and rear slot 22.

Binding means 34, 36 are mounted onto the generally planar top section 13 and provide a means for coupling a user's foot to the ski chassis member 12. A wide variety of binding means 34, 36 are contemplated by the present invention and those skilled in the art will understand and appreciate that the following described binding means are intended to be examples only and not limited to the scope of the present invention. Binding means 34, 36 may include step-in-type bindings as illustrated in FIG. 1. Step-in-type bindings are well known, are used in snow skiing in combination with snow ski boots and release upon application of sufficient load to the binding means, Alternatively, as illustrated in FIGS. 7 and 8, the binding means 110 may also consist of a boot 112 mounted onto the ski chassis member 12 using threaded screw members 118 and 122 which are received within threaded bores 120, 124. The binding means 110 retains the boot 112, and any toe molding 114 or heel molding 116 associated with the boot, on the ski chassis in a manner intended to be substantially non-removable by the user. The toe molding 114 and the heel molding 116 may be optionally included to increase the contact surface area between the boot and the ski chassis member 12 and aids in transferring forces from the user to the ski chassis 12 to control movement and direction of the ski simulation apparatus during use. Still alternatively, and as illustrated in FIG. 8, the binding means 130 may consist of a shell 150 having a toe cup 134, a heel cup 132 and an adjustable strap 133 or buckle or other suitable means for securing the user's foot within the toe cup 134 and heel cup 132. A forward toe plate 136 and a rear heel plate may also be provided to increase the contact surface area between the shell 150 and to aid in transferring forces from the user to the ski chassis 12 during use. The shell 150 may be attached to the ski chassis member 12 in any of a variety of manners, including, without limitation, adhesives, couplings, removable couplings, threaded couplings or their functional equivalents. For example, it is contemplated that the shell 150 may have a mechanical coupling which interlocks with a coupling member on the ski chassis member 12 to permit the user to remove the shell by mechanically decoupling the shell 150 from the coupling member on the ski chassis member 12.

To allow for a minimum height profile of the ski chassis member 12, it has been found that the intermediate wheels 30 project upwardly from the intermediate slot 24 and extend above the top surface 13 of the ski chassis member 12. Because the intermediate slot 24 and the intermediate wheels 30 are positioned below the user's boot, it has been found desirable to include a thickened section 32 of the intermediate section 18 of the ski chassis member. The thickened section 32 may be formed as an integral section of the ski chassis member 12, or may be provided as a spacing element attached to the top section 13 of the ski chassis member 12. The thickened section 32 raises the level of the top section 13 in the area of the intermediate section 18 of the ski chassis member 12 and effectively increases the depth of the intermediate slot 24 to provide clearance between the user's boot and the wheels 30. An additional functional benefit is also realized by use of the thickened section 32. By raising the user's boot height relative to the axle member 56 height, the distance between the user's center of gravity and the axle member 56 height is increased, resulting in an increased ability of the user to "edge" by laterally pivoting the ski chassis member 12 on the plurality of wheels 26, 28 and 30.

As illustrated in FIGS. 1 and 3, the ski simulation apparatus 10 may also be provided with a brake means 40. Brake means 40 preferably consists of a manually actuatable brake mechanism which the user actuates to cause a brake shoe member 42 to impinge upon the dry-land running surface and decelerate and stop the ski chassis member 12 when in motion. The brake means 40 consists generally of a brake lever 46, preferably mountable upon a ski pole 48 to facilitate ease of use, a brake cable 44, and a brake assembly 42 attached to the rear section 16 of the ski chassis member 12. A preferred embodiment of the brake means 40 is illustrated in FIGS. 3 and 4. Brake means 40 is attached to the rear section 16 of the ski chassis member 12 by a bracket member 60 which is coupled to the downwardly extending projection 15 of the ski chassis member. The rear section 16 of the ski chassis member preferably has a longitudinally oriented recess 82 formed within the projection 15. The recess 82 receives the bracket member 60 therein and the bracket member 60 is secured therein by suitable means, such as by attachment to the axle members 56. Bracket member 60 extends rearward from the rear section 16 of the ski chassis member and has a outward projection section 62 for coupling to the brake assembly 42.

The brake assembly 40 preferably consists of a brake shoe mount member 64 which receives and retains a brake shoe member 66 therein. The brake shoe member 66 has a brake pad surface 68 which impinges upon running surface 2 and creates friction therebetween to decelerate the ski chassis member 12. The brake shoe mount member 64 has a flange extension member 65 extending therefrom which is pivotally coupled by a pivot member 76 to the outward projection section 62 of the bracket member 60. The brake shoe mount member 64 is under spring tension exerted by a tensioning spring 78 cooperating with the pivot member 76 and the flange extension member to retain the brake mount member 64 in its retracted position during non-braking conditions. The brake cable 44 has a brake cable terminator section 72 which terminates in a brake cable attachment 74 which couples the brake cable 44 to the brake shoe mount member 64. The spring tension exerted by tensioning 78 is overcome by applying a force to the brake cable by actuating the brake lever 46, attached to a ski pole 48 by a suitable attachment, such as attachment collar 49, to transfer the force generated at the brake lever 46, through the brake cable 44, to the brake shoe mount member 64, overcoming the spring tension exerted by the tensioning spring 78 to extend the brake member 66 in the direction of directional arrow 70 and into contact with the running surface to decelerate the ski chassis member 12.

It will be understood$_1$ however, that the brake means 40 described above is but an example of a variety of braking mechanisms useful in conjunction with the present invention. Other types of brake assemblies, such as caliper and disk-type brakes, brake pads which impinge upon the wheels, or brakes which are electronically or hydraulically actuated are also contemplated by the present invention.

It will also be understood$_1$ that as illustrated in FIGS. 8 and 9, the plurality of wheels 140, 142, 144 may also consist of in-line wheel pairs wherein the front wheel pair 140, the rear wheel pair 142 and the intermediate wheel pair 144 each consist of laterally adjacent wheels 146, 148 on a common axle member 56, in which each of the front wheel pair 140, the rear wheel pair 142 and the intermediate wheel pair 144 are co-axially aligned along the longitudinal axis of the ski chassis member 12.

Finally, alternative configurations of the ski chassis member are also contemplated by the present invention. As illustrated in FIGS. 5 and 6, the ski chassis member 12 may be configured with lateral side cuts 102 and 104 on opposing lateral sides of the top surface 13 to form a narrowed neck region interconnecting the front section 14 and the intermediate section 18 of the ski chassis member 12 and a narrowed neck region interconnecting the rear section 16 and the intermediate section 18. In addition, or as an alternative to the lateral side cuts 102, 104, the downwardly extending projection 15 may have shortened regions 106 and 108 which shorten the downward extent of projection 15. Each of the lateral side cuts 102 and 104 or the shortened regions 106 and 108 of the ski chassis member serve to relatively weaken those sections of the ski chassis member to increase either the longitudinal flexibility of the ski chassis member 12 and/or the torsional rigidity of the ski chassis member 12 and effectuate altered flex profiles for the ski simulation apparatus 10.

In accordance with the best mode known to the inventor, the ski chassis member 12 is preferably fabricated by either molding or extruding a plastic polymer selected from the group of nylon, polyethylene, polycarbonate, polypropylene, polystyrene, and polystyrene-acrylonitrile or thermoform plastics having sufficient tensile strength to withstand repeated stresses without fracturing. Alternatively, composite materials, such as laminated carbon-fiber materials or synthetic fiber materials such as that sold under the trademark KEVLAR by DuPont, may be used to fabricate the ski chassis member. Still further, composites or laminates of plastics, fiberglass, carbon or synthetic fiber, metals, such as steel, titanium, aluminum or the like may be used to make the ski chassis member 12.

Those skilled in the art will understand and appreciate that the present invention has been fully described with reference to its preferred embodiments and changes may be made to the configuration, material selection, construction or operation of the above-described invention and still remain within the scope of the present invention, which is intended to be limited only by the appended claims.

I claim:

1. A skiing simulation apparatus, comprising:

an elongate ski chassis member having a generally T-shaped transverse sectional shape, a front section, a rear section and an intermediate section defining the longitudinal axis of the ski chassis member and a plurality of open slots passing vertically through the elongate ski chassis member and being aligned along the longitudinal axis of the ski chassis member in spaced relationship to one another, at least one of the plurality of open slots being positioned in each of the front section, the rear section and the intermediate section of the ski chassis member;

a plurality of in-line wheel pairs, at least one of the plurality of in-line wheel pairs being operably disposed in the at least one of the plurality of open slots positioned in each of the front section, rear section and intermediate section of the ski chassis member and rotatable therein parallel to, and aligned with, the longitudinal axis of the ski chassis member, such that the rotational axes of the wheel members are perpendicular to the longitudinal axis of the ski chassis member, the at least one of the plurality of in-line wheel pairs disposed in the open slot in the intermediate section of the ski chassis member having a first diameter, and the at least one of the plurality of in-line wheel pairs disposed in the open slots in the front and rear sections of the ski chassis member having a second diameter larger than the first diameter of the at least one of the plurality of in-line wheel pairs disposed in the open slot in the intermediate section of the ski chassis member; and binding means for removably engaging a wearer's foot to the elongate chassis member.

2. The skiing simulation apparatus of claim 1, wherein the ski chassis member is made of a plastic material selected from the group consisting of nylon, polyethylene, polycarbonate, polypropylene, polystyrene, and polystyrene-acrylonitrile.

3. The skiing simulation apparatus according to claim 1, further comprising a brake member operably mounted at a rear end of the ski chassis member which is manually extensible to impinge upon a dry-land running surface and decellerate the ski chassis member when it is in motion.

4. The skiing simulation apparatus according to claim 3, further comprising a brake actuation lever mountable onto a ski pole and a brake cable interconnecting the brake actuation lever with the brake member, whereby a force exerted by manual actuation of the brake actuation lever is transmitted through the brake cable to the brake member, causing the brake member to impinge against the dry-land running surface to decellerate the dry-land ski simulation apparatus.

5. The skiing simulation apparatus according to claim 1, wherein the binding means further comprises a toe binding member and a heel binding member, each capable of releasing the user's foot therefrom upon exertion of a torsional load applied to the dry-land snow skiing simulation apparatus or to the user's foot.

6. The skiing simulation apparatus according to claim 1, wherein the binding means further comprises a toe molding, a heel molding and a strap adjustable to retain the user's foot therein.

7. The skiing simulation apparatus according to claim 1, wherein the binding means further comprises a boot non-releasably coupled to the ski chassis member, whereby a user inserts a user's foot into the boot.

8. A dry-land snow skiing simulation apparatus, comprising:

an elongate ski chassis member having a longitudinal axis, a substantially planar top surface, a bottom surface and a plurality of open slots passing through the elongate ski chassis member, the plurality of open slots being aligned along, and extending parallel to, the longitudinal axis of the elongate ski chassis member and being arrayed as a front slot, a rear slot and an intermediate slot, the intermediate slot located below the positioning of a user's foot; and a plurality of in-line wheel pairs arrayed as a first in-line wheel pair rotatably coupled within the front slot proximate the front end of the ski chassis member, a second in-line wheel pair rotatably coupled within the rear slot proximate a rear end of the ski chassis member, and a third in-line wheel pair rotatably coupled within an intermediate slot positioned intermediate the front slot and the rear slot of the ski chassis member; and binding means for removably coupling a user's foot to the elongate ski chassis member.

9. The dry-land snow skiing simulation apparatus of claim 8, wherein the elongate projection is integral with the ski chassis member and is formed as a unitary part thereof.

10. The dry-land snow skiing simulation apparatus of claim 8, wherein the ski chassis member is made of a plastic material selected from the group consisting of nylon, polyethylene, polycarbonate, polypropylene, polystyrene, and polystyrene-acrylonitrile.

11. The dry-land snow skiing simulation apparatus of claim 8, further comprising a plate member interdisposed between the binding means and the top surface of the ski chassis member.

12. The dry-land snow skiing apparatus of claim 11, wherein the plate member further comprises a longitudinally extending opening passing through the plate member, the longitudinally extending opening being configured to cooperate with at least one of the plurality of open slots in the ski chassis member and permit rotation of the wheel members within the at least one of the plurality of open slots.

13. The dry-land snow skiing simulation apparatus according to claim 8, further comprising a brake member operably mounted at a rear end of the ski chassis member which is manually extensible to impinge upon a dry-land running surface and decelerate the ski chassis member when it is in motion.

14. The dry-land snow skiing simulation apparatus according to claim 13, further comprising a brake actuation lever mountable onto a ski pole and a brake cable interconnecting the brake actuation lever with the brake member, whereby a force exerted by manual actuation of the brake actuation lever is transmitted through the brake cable to the brake member, causing the brake member to impinge against the dry-land running surface to decelerate the dry-land ski simulation apparatus.

15. The dry-land snow skiing simulation apparatus according to claim 8, wherein the binding means further comprises a toe binding member and a heel binding member, each capable of releasing the user's foot therefrom upon exertion of a torsional load applied to the dry-land snow skiing simulation apparatus or to the user's foot.

16. The dry-land snow skiing simulation apparatus according to claim 8, wherein the binding means further comprises a toe molding, a heel molding, and a strap adjustable to retain the user's foot therein.

17. The dry-land snow skiing simulation apparatus according to claim 8, wherein the binding means further comprises a boot non-releasably coupled to the ski chassis member, whereby a user inserts a user's foot into the boot.

18. The dry-land snow skiing simulation apparatus according to claim 8, wherein the ski chassis member further comprises a forward laterally tapered neck section and a rear laterally tapered neck section.

19. The dry-land snow skiing simulation apparatus according to claim 18, wherein the forward laterally tapered neck section and the rear laterally tapered neck section further include vertically tapered sections of the ski chassis member.

20. The dry-land snow skiing simulation apparatus of claim 8, wherein the first in-line wheel pair and the second in-line wheel pair have substantially identical diameters and the third in-line wheel pair has a second, smaller wheel diameter than the first and second in-line wheel pairs.

* * * * *